United States Patent [19]

Höglund

[11] Patent Number: 5,074,995

[45] Date of Patent: Dec. 24, 1991

[54] APPARATUS FOR SEPARATING PARTICLES FROM A PULP FLOW AND DIVIDING THE FLOW INTO FRACTIONS

[75] Inventor: Ronny Höglund, Skoghall, Sweden

[73] Assignee: Kamyr Aktiebolag, Karlstad, Sweden

[21] Appl. No.: 597,166

[22] Filed: Oct. 15, 1990

[30] Foreign Application Priority Data

Nov. 22, 1989 [SE] Sweden ..... 8903912

[51] Int. Cl.[5] ..... B07B 1/00

[52] U.S. Cl. ..... 209/268; 209/273

[58] Field of Search ..... 209/233, 268, 270, 273; 162/55

[56] References Cited

U.S. PATENT DOCUMENTS

| | | | |
|---|---|---|---|
| 4,303,508 | 12/1981 | Skretting | 209/297 |
| 4,737,274 | 4/1988 | Jacobsen et al. | 209/268 |
| 4,911,828 | 3/1990 | Musselmann et al. | 162/55 X |
| 4,941,970 | 7/1990 | Ahs | 209/234 |
| 4,968,417 | 11/1990 | Ahs | 209/273 |
| 4,991,720 | 2/1991 | Hoglund et al. | 209/234 X |

*Primary Examiner*—Michael S. Huppert
*Assistant Examiner*—Edward M. Wacyra
*Attorney, Agent, or Firm*—Cushman, Darby & Cushman

[57] ABSTRACT

An apparatus for separating undesired particles from a suspension flow of pulp and for dividing the suspension flow into fractions is described. The apparatus comprises a housing having a first chamber with an inlet for the suspension flow and a first outlet for the undesired particles, a second chamber with a second outlet and communicating with the first chamber through a first annular gap, and a third chamber with a third outlet and communicating with the second chamber through a second annular gap, the radial extension of the second gap being less than that of the first gap. First and second rotating discs are carried by a shaft for common rotation therewith. The first disc is disposed in the first chamber in front of the first gap to separate the undesired particles by means of teeth protruding from the first disc. The second disc is disposed in the second chamber in front of the second gap to remove, by means of teeth protruding from the second disc, particles in form of twigs, undissolved fiber bundles and any remaining undesired particles from the suspension flow in front of the second gap. The discs have cavities axially aligned with the first and second gaps, respectively, to form axial passages, said second disc and said second gap cooperating to divide the suspension flow into a coarse fraction which is removed through the second outlet and a finer fraction which passes through said second annular gap and is removed through the third outlet.

11 Claims, 1 Drawing Sheet

APPARATUS FOR SEPARATING PARTICLES FROM A PULP FLOW AND DIVIDING THE FLOW INTO FRACTIONS

FIELD AND BACKGROUND OF THE INVENTION

The present invention relates to an apparatus for separating undesired particles from a suspension flow of cellulosic fibrous material and for dividing the suspension flow into at least two fractions.

When preparing cellulosic pulp, impurities are supplied both from the outside and also due to deficiencies in the manufacturing process per se. These undesired particles may vary in size and consist of sand, gravel, stones, nuts and bolts, bits of welding electrodes and pieces of metal. It is therefore necessary to remove such undesired particles, particularly from suspensions which either are to be processed further in sensitive machines and equipment which might be damaged by such solid particles or from which the impurities shall be removed as far as possible for other reasons. Various types of equipment, known as scrap separators, for separating out undesired solid particles from a cellulosic pulp have already been proposed, see for instance the patent specifications U.S. Pat. No. 4,737,274 (corresponding to SE 8503372-8), SE 8702744-7 and U.S. Pat. No. 4,941,970 (corresponding to SE 8702745-4). The two latter patent specifications describe screening apparatus with rotating separating means of the same type as that described in U.S. Pat. No. 4,737,274, and with screening drums, for producing accept suitable for bleaching.

U.S. Pat. No. 4,303,508 (corresponding to SE 7903032-6) describes a screening device for separating undesired particles from a suspension flow. The screening device has a rotating screening drum provided with a plurality of circular slits through which a finer portion can pass for separate removal, while a coarser portion containing undesired particles is removed through a reject outlet. The undesired particles can be removed from the coarser portion after passage through the reject outlet. In order to keep the slits of the screening drum open they must be continuously cleared by means of special stationary ridges extending into the slits. The screening device can be used as a partial flow screen to recover a partial flow which is free from twigs, e.g. 25% of a pulp flow can be withdrawn in form of a partial flow free from twigs for liner manufacture.

Two different sets of apparatus with separate drive means have consequently been required to effect partial flow screening and separation of undesired particles from a pulp suspension.

SUMMARY OF THE INVENTION

The object of the present invention is to provide a multi-functional, simple apparatus which, in the order mentioned, continuously carries out a separation of undesired particles of the type mentioned, and, without the use of a screening drum, dividing of the suspension flow thus cleansed into at least two fractions, said apparatus having a common drive means for both these functions. In this way reduced operation, installation and apparatus costs are obtained.

The invention relates to an apparatus for separating undesired particles from a suspension flow of cellulosic fibrous material and for dividing the suspension flow into at least two fractions, said apparatus comprising a closed housing having a first chamber with an inlet for said suspension flow and a first outlet for said undesired particles, a second chamber with a second outlet and communicating with said first chamber through a first annular gap, and a third chamber with a third outlet and communicating with said second chamber through a second annular gap, said chambers being axially aligned and having a common longitudinal axis and a rotatable shaft coincident with said longitudinal axis, the radial extension of said second annular gap being less than that of said first annular gap, first and second rotating members carried by said shaft for common rotation therewith, said first rotating member being disposed in said first chamber in front of said first annular gap to separate said undesired particles by means of elements radially protruding from said first rotating member, said second rotating member being disposed in said second chamber in front of said second annular gap to remove, by means of elements radially protruding from said second rotating member, particles in form of twigs, undissolved fiber bundles and any remaining undesired particles from the suspension flow in front of said second annular gap, said first and second rotating members having cavities located between said protruding elements and being axially aligned with said first and second annular gaps, respectively, to form axial passages, said second rotating member and said second annular gap cooperating to divide the suspension flow into a coarse fraction which is removed from the second chamber through said second outlet and a finer fraction which passes through said second annular gap and is removed from the third chamber through said third outlet.

BRIEF DESCRIPTION OF THE DRAWINGS

The invention will be described in the following in more detail by way of an example with reference to the accompanying drawings.

DESCRIPTION OF ILLUSTRATED EMBODIMENT

Figure 1:
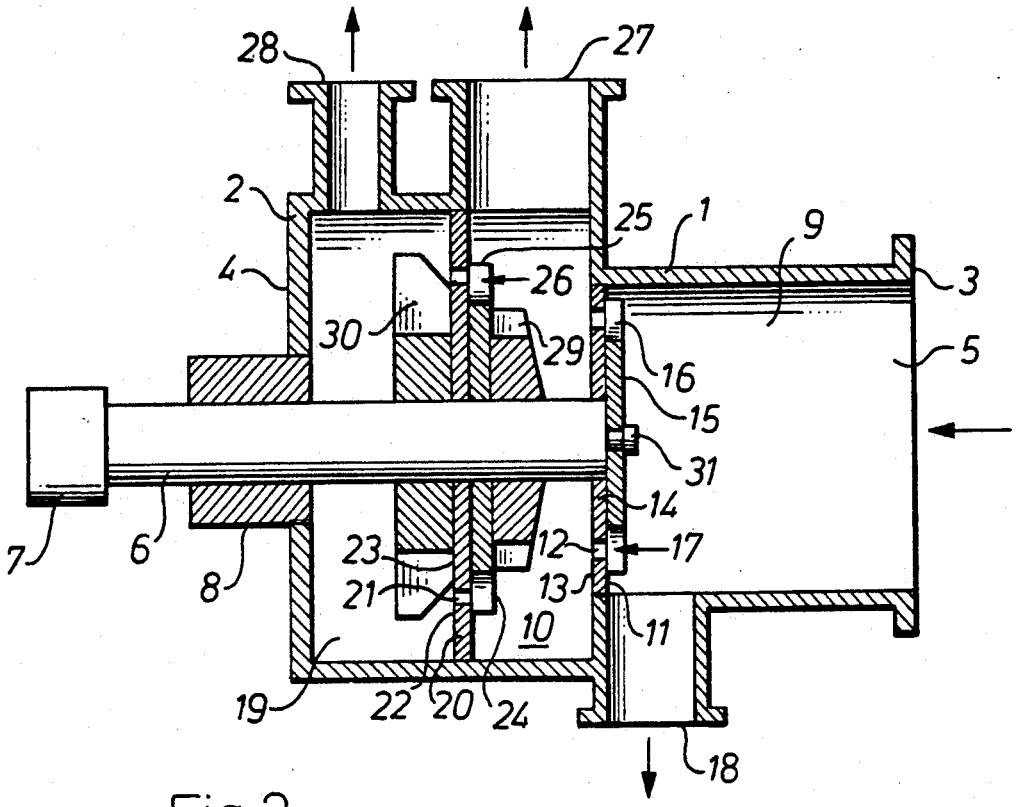
FIG. 1 shows schematically an apparatus according to the invention in a longitudinal section.

The apparatus shown schematically in FIG. 1 comprises a closed housing 1 with two opposite ends 2, 3, one of which being closed by an end wall 4 and the other being provided with a large opening forming an inlet 5, the diameter of which may be as large as the diameter of the housing in the vicinity of this inlet.

A horizontal rotatable shaft 6 is arranged to extend a predetermined distance through the end wall 4 into the housing 1. The shaft 6 is driven by a motor 7 and is carried by a support and bearing unit 8 including suitable sealing means to ensure sealing between the shaft 6 and the end wall 4 of the housing.

The housing comprises a first chamber 9 located close to its end 3 and thus receives the suspension flow of cellulosic fibrous material supplied for treatment through the inlet 5. A second chamber 10 is disposed axially after, i.e. inside the first chamber 9, seen in the direction of flow, these chambers 9 and 10 being separated by a partition wall 11 and communicating with each other by means of a first annular, circular, coaxial gap or opening 12 in the partition wall 11. The partition wall comprises an outer part 13 rigidly secured to the housing, and an inner part 14 rigidly secured to the shaft 6 and located radially inside the outer part 13. In the embodiment illustrated the outer part 13 consists of a flat ring and the inner part 14 of a flat plate. The ring 13 and plate 14 thus define said annular gap 12 between them, the gap having predetermined inner and outer radii, and thus a predetermined width, i.e. radial extension.

The shaft 6 carries a first coaxial member 15, rotating together with the shaft, in the form of a flat circular disc which is disposed in the first chamber 9 in front of the annular gap 12 in order to separate undesired particles from the suspension as it flows through the apparatus. The peripherical portion of the disc 15 is provided or formed with elements 16 protruding in the plane of the disc in the form of teeth, cogs or the like which may have substantially radial extension or may be inclined slightly backwards seen in the direction of rotation of the disc 15. The toothed disc 15 is provided with cavities 17 which are axially aligned with said annular gap 12 to form axial passages for the suspension allowing it to flow to the second chamber 10 via the annular gap 12. These cavities 17 are formed by the spaces between the teeth 16 of the toothed disc 15. The radial width of the annular gap 12 is preferably slightly smaller than the radial extension of the teeth 16. The annular gap 12 lies within the radial extension of the teeth so that a circle drawn through the tops of the teeth 16 with the shaft 6 as centre has a diameter slightly greater than the outer diameter of the annular gap 12 and a circle drawn through the bases of the teeth 16 has a diameter slightly smaller than the inner diameter of the annular gap 12. The toothed disc 15 and the outer ring 13 are disposed as close together as possible without friction occurring. The toothed disc 15 is rigidly mounted to the inner end of the shaft 6 by means of suitable attachment means 31 and the inner plate 14 is fixed to the shaft 6 so that the plate 14, toothed disc 15 and shaft 6 rotate together as a unit. The undesired particles which are hit by the teeth 16 of the toothed disc 15 during rotation of the disc are thrown out in the direction to the inside of the housing and are removed through an outlet 18 from the first chamber 9. The outlet 18 is located in the plane of the toothed disc 15 on the lower portion of the housing.

Figure 2:
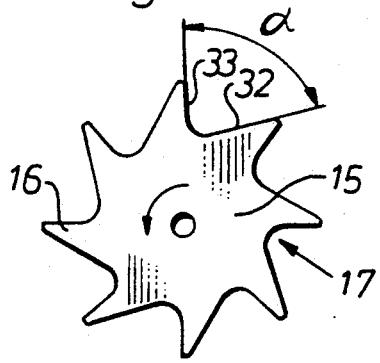
FIGS. 2 and 3 show suitable embodiments of the rotating toothed members included in the apparatus.

A suitable embodiment of a toothed disc 15 is shown in FIG. 2, in which the direction of rotation is indicated by an arrow. The front tooth surface 32 of a tooth 16, seen in the direction of rotation, forms an angle $\alpha$ with the rear tooth surface 33, suitably radial, of the tooth located immediately in front. The angle $\alpha$ can suitably be from 60° to 75°, so that the undesired solid particles are thrown in the direction outwards and obliquely backwards during rotation of the toothed disc in the direction of the arrow, and are thus prevented from passing axially or transversely through the toothed disc 15. The impurities separated out may also comprise largish twigs and pieces of wood. However, the main part of these naturally included particles accompany the suspension through the annular gap 12 into the second chamber 10.

The outlet 18 for the undesired particles is connected to suitable equipment (not shown) for collecting and removing the particles separated out of the suspension flow. Liquid, usually water can be supplied to this equipment to provide a slight counterflow of liquid through the apparatus to prevent it becoming filled with fibers from the suspension but will contain substantially the undesired particles separated out.

In accordance with the present invention the housing also comprises a third chamber 19 which, seen in the direction of flow, is disposed axially after the second chamber 10, close to the end wall 4 of the housing. The two adjacent chambers 10, 19 are separated by a partition wall 20 and communicate with each other by means of a second annular, circular, coaxial gap or opening 21 in the partition wall 20. The partition wall is formed by an outer part 22 rigidly secured to the housing and an inner part 23 rigidly secured to the shaft 6 and located radially inside the outer part 22. In the embodiment illustrated the outer part 22 consists of a flat ring and the inner part 23 also of a flat ring through which the shaft 6 extends. The rings 22 and 23 thus define said annular gap 21 between them, the gap having predetermined inner and outer radii, and thus a predetermined width, i.e. radial extension. The toothed ring 24 and said inner part 23 are in surface contact with each other.

The shaft 6 carries a second coaxial member 24, rotating together with the shaft and disposed in the second chamber 10, immediately in front of the annular gap 21. The second rotating member 24 is in the form of a flat circular ring, the peripherical portion thereof being provided or formed with elements 25 protruding in the plane of the ring in the form of teeth, cogs or the like which may have substantially radial extension or may be inclined slightly backwards seen in the direction of rotation of the ring element. The toothed ring 24 is provided with cavities 26 which are aligned with said annular gap 21 to form axial passages for the suspension allowing it to flow to the third chamber 19 via the annular gap 21. These cavities 26 are formed by the spaces between the teeth 25 of the toothed ring 24. The radial width of the annular gap 21 is preferably slightly less than the radial extension of the teeth 25. The annular gap 21 lies axially within the radial extension of the teeth 25 so that a circle drawn through the tops of the teeth 25 with the shaft 6 as centre has a diameter equal to or slightly greater than the outer diameter of the annular gap 21 and a circle drawn through the bases of the teeth 25 has a diameter equal to or slightly smaller than the inner diameter of the annular gap 21. The toothed ring 24 and the stationary outer ring 22 are disposed as close each other as possible without friction occurring. Alternatively the diameter of the toothed ring 24 (at the tops of the teeth) may be slightly less than the outer diameter of the annular gap 21 in order to facilitate assembly and dismantling of the toothed ring 24 (via the annular gap 21) without the ring 22 having to be removed.

Figure 3:
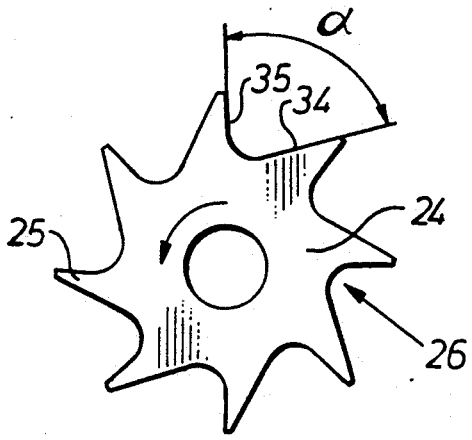

A suitable embodiment of a toothed ring 24 is shown in FIG. 3 where the direction of rotation is indicated by an arrow. The front tooth surface 34 of a tooth 25, seen in the direction of rotation, forms an angle $\alpha$ with the rear tooth surface 35, suitably radial, of the tooth located immediately in front. The angle $\alpha$ can suitably be from 60° to 75°, so that the solid particles in the pulp are thrown in the direction outwards and slightly backwards during rotation of the toothed ring 24, and are thus prevented from passing axially or transversely through the toothed ring 24. The particles separated out comprise primarily twigs and undissolved bundles of fibers.

Further, the housing is provided with a radial outlet 27 connected to the second chamber 10 for discharging the coarser fraction thus obtained, and a radial outlet 28 connected to the third chamber 19 for discharging the finer fraction thus obtained. The outlets 27, 28 are suitably disposed on the upper side of the housing 1.

In the second chamber 10 the shaft 6 is provided with a plurality of vanes 29 or similar projections which are arranged to increase the feed-out effect of the coarser fraction through the outlet 27. A plurality of vanes 30 or similar projections are also mounted on the shaft 6 in the third chamber 19 in order to increase the feed-out effect of the finer fraction through the outlet. The last-mentioned vanes 30 may be radially larger and wider than the first-mentioned vanes 29 as shown in FIG. 1.

The width of the annular gap 21 located between the second chamber 10 and the third chamber 19, i.e. its radial extension, is less than the radial width of the annular gap 12 located between the first chamber 9 and the second chamber 10. The annular gap 12 has a radial width of about 10–20 mm, whereas the annular gap 21 has a radial width of about 3–8 mm, the difference between the radial widths of the gaps being at least 5 mm, preferably at least 8 mm in each individual cases. Furthermore, the through-flow areas of the two annular gaps 12, 21 are considerably smaller than the through-flow area of the inlet 5. The through-flow area of the annular gap 12 is preferably about half to one quarter of the through-flow area of the inlet 5.

The suspension which flows under pressure into the apparatus through the large inlet 5, is forced outwards to the annular gap 12 to pass through this via the spaces 17 in the rotating toothed disc 15. The undesired particles which are hit or otherwise influenced by the teeth 16 during rotation of the toothed disc 15 are thrown out in the direction to the wall of the housing, and are removed through the outlet 18. Even particles smaller than the radial width of the annular gap 12, hit by the teeth 16, will be separated away and removed through the outlet 18. The said reduction of the through-flow area causes acceleration of the suspension to a higher speed, and at the same time fluidization, which is particularly important when the fiber pulp is of medium consistency, i.e. 6–15%. During rotation of the toothed disc 15 in front of the annular gap 12, its teeth 16 will generate shearing forces in the suspension, thereby transforming it to a fluidized state, i.e. easy flowing. Since the toothed disc 15 is located close to the annular gap 12, the suspension will thus pass through the annular gap in fluidized state. The toothed disc 15 also has a clearing function since it prevents large particles in the suspension from collecting in front of the annular gap 12 and getting caught in the gap. In the second chamber 10 the suspension is subjected to the action of the second rotating member in the form of the toothed ring 24. This functions in the same way as the toothed disc 15, and as the toothed ring 24 rotates in front of the annular gap 21 the teeth 25 thus will generate shearing forces in the suspension, thereby achieving a fluidized state, and allowing the desired suspension to pass more easily through the annular gap 21 via the spaces 26 between the teeth 25 on the toothed ring 24 in the same way as described for the toothed disc 15. The toothed ring 24 thus also has a clearing function since it prevents large particles in the suspension from collecting in front of the annular gap 21 and getting caught in the gap. Furthermore, the toothed ring 24 separates twigs and bundles of fibers from the suspension when these twigs and fiber bundles are hit by the teeth 25 of the rapidly rotating toothed ring and are thrown radially outwards, accompanying the coarser fraction thus obtained out through the outlet 28.

The leading tooth surfaces 32 and 34, of the toothed disc 15 and toothed ring 24, respectively, may be inclined axially inwards to face the annular gap 12 and 21, respectively, at a suitable angle so as to provide a favourable propeller-like axial feeding effect on the suspension.

The apparatus can be used to treat any kind of pulp suspension from which foreign particles such as scrap material are to be removed, and the suspension divided into a partial flow free from twigs and a partial flow containing twigs, usually termed the coarse fraction. The ratio between these partial flows may be between 50:50 and 30:70, in said order. The apparatus can be mounted with advantage in the blow pipe from a continuous pulp digester, in order to separate foreign particles which might damage subsequent process machines and in order to simultaneously divide the pulp flow thus cleaned into a partial flow free from twigs which can be used for specific purposes, and a partial flow containing twigs which can be subjected to a refining process. A suitable speed for the shaft 6 is about 1500 rpm for a pulp of medium consistency, i.e. about 6–15%.

If desired, the apparatus may be provided with yet another chamber, for instance, similar to and disposed axially after the third chamber. In this case the radial width of the annular gap between the third chamber and such a fourth chamber is slightly less than the radial width of the immediately preceding annular gap 21, thus enabling an additional, even finer fraction to be discharged from the fourth chamber. A rotating member with protruding elements such as teeth, substantially similar to the rotating member 24, is then disposed in the third chamber in front of the additional annular gap and the wheel with vanes 30 is then suitably moved to the additional rotating toothed ring.

The annular gaps described herein are non-obstructed, i.e. they are free of any structural elements, so that they are continuous circumferentially (endless).

That which is claimed is:

1. An apparatus for separating undesired particles from a suspension flow of cellulosic fibrous material and for dividing the suspension flow into at least two fractions, said apparatus comprising a closed housing having a first chamber with an inlet for said suspension flow and a first outlet for said undesired particles, a second chamber with a second outlet and communicating with said first chamber through a first annular gap, and a third chamber with a third outlet and communicating with said second chamber through a second annular gap, said chambers being axially aligned and having a common longitudinal axis and a rotatable shaft coincident with said longitudinal axis, the radial extension of said second annular gap being less than that of said first annular gap, first and second rotating members carried by said shaft for common rotation therewith, said first rotating member being disposed in said first chamber in front of said first annular gap to separate said undesired particles by means of elements radially protruding from said first rotating member, said second rotating member being disposed in said second chamber in front of said second annular gap to remove, by means of elements radially protruding from said second rotating member, particles in form of twigs, undissolved fiber bundles and any remaining undesired particles from the suspension flow in front of said second annular gap, said first and second rotating members having cavities located between said protruding elements and being axially aligned with said first and second annular gaps, respectively, to form axial passages, said second rotating member and said second annular gap cooperating to divide the suspension flow into a coarse fraction which is removed from the second chamber through said second outlet and a finer fraction which passes through said second annular gap and is removed from the third chamber through said third outlet.

2. An apparatus as recited in claim 1 wherein the through-flow area of each of said first and second annular gaps are considerably smaller than the through-flow area of said inlet to the first chamber.

3. An apparatus as recited in claim 2 wherein the through-flow area of said first annular gap located between said first chamber and said second chamber is about half to one quarter of the through-flow area of said inlet.

4. An apparatus as recited in claim 1 wherein said first annular gap located between said first chamber and said second chamber has a radial extension of about 10–20 mm, and said second annular gap located between said second chamber and said third chamber has a radial extension of about 3–8 mm, the difference between the radial widths of said first and second annular gaps being at least 5 mm.

5. An apparatus as recited in claim 4 wherein said radial width difference preferably is at least 8 mm.

6. An apparatus as receited in claim 1 wherein said second annular gap is defined radially outwardly by an outer ring rigidly secured to the housing, and radially inwardly by an inner ring rigidly secured to said shaft.

7. An apparatus as recited in claim 6 wherein said second rotating member is in the form of a toothed ring disposed in close surface contact with said inner ring.

8. An apparatus as receited in claim 1 wherein a plurality of vanes are disposed in said second and third chambers in order to increase the feed-out effect of the fractions, said vanes being rigidly secured to said shaft.

9. An apparatus as recited in claim 1 wherein the radial extension of said second annular gap is slightly less than the radial extension of said protruding elements of said second rotating member.

10. An apparatus as recited in claim 1 wherein said second annular gap is axially located within the radial extension of said protruding elements of said second rotating member.

11. An apparatus as recited in claim 1 wherein the largest diameter of said second rotating member is slightly less than the outer diameter of said second annular gap.

* * * * *